US007045694B2

(12) United States Patent
Yasunori

(10) Patent No.: US 7,045,694 B2
(45) Date of Patent: May 16, 2006

(54) FIXTURE

(76) Inventor: Masatoshi Yasunori, 5-21-902, Shinmachi 3-chome, Nishi-ku, Osaka-shi, Osaka 550-0013 (JP)

( * ) Notice: Subject to any disclaimer, the term of this patent is extended or adjusted under 35 U.S.C. 154(b) by 87 days.

(21) Appl. No.: 10/724,220

(22) Filed: Dec. 1, 2003

(65) Prior Publication Data

US 2004/0159208 A1 Aug. 19, 2004

(30) Foreign Application Priority Data

Dec. 2, 2002 (JP) ..... 2002-349730

(51) Int. Cl.
*G10D 3/00* (2006.01)

(52) U.S. Cl. ..... 84/329; 24/633

(58) Field of Classification Search ..... 84/327, 84/329, 421, 453; 24/633
See application file for complete search history.

(56) References Cited

U.S. PATENT DOCUMENTS 4,624,033 A * 11/1986 Orton ..... 24/633
4,993,127 A * 2/1991 Mechem et al. ..... 24/701

* cited by examiner

*Primary Examiner*—David Martin
*Assistant Examiner*—Jianchun Qin
(74) *Attorney, Agent, or Firm*—Birch, Stewart, Kolasch & Birch, LLP

(57) ABSTRACT

A fixture is made up of: a made body 10 composed of a placement portion 12 in which a stripe-shaped member (strap 3) or a line-shaped member is inserted and placed, a through hole 15 through which a bulging portion 2*b* of an attachment target section 2 can be inserted, and an insertion groove 16 linked to the through hole 15 and extended from the through hole 15 to an opposite side of the placement portion 12 in which the shaft portion 2*a* of the attachment target section 2 is inserted; engagement members 23 that are rotatably mounted on the main body 10 and that are composed of engagement portions 25 projected inside the insertion groove 16 to form a small hole B larger than the shaft portion 2*a* and smaller than a bulging portion 2*b* along with an end portion of the insertion groove 16, and operation portions 28 projected outward from the main body 10: and a biasing member 29 for biasing the engagement members 23 so as to retain the engagement portions 25 of the engagement members 23 in a state of being projected inside the insertion groove 16 of the main body 10. A fixture including: a main body composed of a placement portion in which a stripe-shaped member or a line-shaped member is inserted and placed, a through hole through which a bulging portion of an attachment target section can be inserted, and an insertion groove linked to the through hole and extended from the through hole to an opposite side of the placement portion, in which the shaft portion of the attachment target section is inserted; engagement members that are rotatably mounted on the main body and that are composed of engagement portions projected inside the insertion groove to form a small hole B larger than the shaft portion and smaller than a bulging portion along with an end portion of the insertion groove, and operation portions projected outward from the main body; and a biasing member for biasing the engagement members.

2 Claims, 6 Drawing Sheets

FIXTURE

This nonprovisional application claims priority under 35 U.S.C. § 119(a) on Patent Application No. 2002-349730 filed in JAPAN on Dec. 2, 2002, the entire contents of which are hereby incorporated by reference.

BACKGROUND OF THE INVENTION

The present invention relates to a fixture for attaching strip-shaped members such as straps to guitars that are attachment objects.

As shown in FIG. 7, on a guitar 1, that is one of the attachment objects to which a strip-shaped member is attached, there are fixed attachment target sections 2 on the both back and front ends of its main body. When a player stands up and plays the guitar, he/she attaches a strap 3 to the attachment target sections 2 and has the strap 3 over his/her shoulder to hold the guitar 1 in place.

As shown in FIGS. 8A and 8B, the attachment target section 2, which is almost T-shaped at cross section, is composed of a shaft portion 2*a* having a circular cross section and a bulging portion 2*b* projected onward on the top end of the shaft portion 2*a*. It is to be noted that an attachment target section 2A shown in FIG. 8A is different from an attachment target section 2B shown in FIG. 8B only in the point that the shaft portion 2*a* and the bulging portion 2*b* of the attachment target section 2A are slightly larger in diameter than those of the attachment target section 2B.

Further, the strap 3 is provided with through holes 3*a* that have a diameter slightly larger than that of the shaft portion 2*a* of the attachment target section 2 and slits 3*b* linked to the through holes 3*a* on the both ends of the strap 3. The bulging portions 2*b* of the attachment target sections 2A, 2B are structured to be inserted through cut portions extended from these through holes 3*a* to slits 3*b*, and the shaft portions 2*a* of the attachment target section 2A, 2B are structured to be positioned in the through holes 3*a*, so that the attachment state is retained by preventing falling-off with the presence of the bulging portions 2*b*.

However, in the above-mentioned attachment structure, there is a problem that if the strip-shaped member is made from a hard material, the workability with respect to attaching and detaching operations is deteriorated although the retentivity to retain the attachment state is increased. Further, there is a problem that if the strip-shaped member is made from a soft material, the workability with respect to attaching and detaching operations is improved, although the retentivity to retain the attachment state is weakened. Thus, if the retentivity of the attachment state is weak, the strap 3 possibly comes loose from the attachment target sections 2, thereby causing an expensive guitar 1 to be dropped off.

It is to be noted that as a structure for attaching a strip-shaped member to this type of attachment target sections 2, there is known a fixture member comprising a so-called gourd-shaped attachment groove composed of a large hole and a small hole linked to each other in the strip-shaped member, and a placement portion on which the strip-shaped member is inserted and placed through the gourd-shaped attachment groove. This fixture member, which is used for safety harnesses of automobiles and the like, is for retaining the attachment state by inserting the bulging portion 2*b* of the attachment target section 2 through the large hole of the gourd-shaped attachment groove and positioning the shaft portion 2*a* in the small hole of the gourd-shaped attachment groove after an engagement piece between the large hole and the small hole is resiliently sagged.

However, the above-mentioned fixture member still has problems that the workability of the attaching operation is deteriorated depending on the projection amount and the material of the engagement piece, and that the retentivity for retaining the attachment state is weakened.

SUMMARY OF THE INVENTION

An object of the present invention is to provide a fixture that is capable of improving the workability of attaching operation for attaching and detaching strip-shaped members and line-shaped members to/from attachment objects, as well as retaining the attachment state with reliability.

In order to achieve the aforementioned object, a fixture of the present invention used in a state that an almost T-shaped attachment target section, that is composed of a shaft portion having a circular cross section and a bulging portion projected outward on a top end of the shaft portion, is disposed on an attachment object, for attaching a strip-shaped member or a line-shaped member to the attachment object via the attachment target section, comprises: a main body composed of a placement portion in which the strip-shaped member or the line-shaped member is inserted and placed, a through hole through which the bulging portion of the attachment target section is inserted, and an insertion groove linked to the through hole and extended from the through hole to an opposite side of the placement portion in which the shaft portion of the attachment target section is inserted; an engagement member that is rotatably mounted on the main body and that is composed of an engagement portion projected inside the insertion groove to form a small hole larger than the shaft portion and smaller than the bulging portion along with an end portion of the insertion groove, and an operation portion projected outward from the main body; and a biasing member for biasing the engagement member so as to retain the engagement portion of the engagement member in a state of being projected inside the insertion groove of the main body.

According to the above-described fixture, for example, the portion of the main body on which the placement portion is provided is hold by a player or a user and the attachment target section is inserted through the through hole, and then the fixture is pulled along the extension direction of the insertion groove. Consequently, the shaft portion of the attachment target section comes into contact with the engagement portion of the engagement member, and the engagement member rotates against biasing force of the biasing member, by which the shaft portion of the attachment target section is inserted in the insertion groove. Then, once the shaft portion goes over the top end position of the engagement portion of the engagement member, the engagement portion of the engagement member is rotated inward by the biasing force of the biasing member, by which the engagement portion returns to the state of being projected inside the insertion groove.

In the case where the fixture is detached from the attachment target section, a player or a user presses the operation portion of the engagement member inward so as to rotate the engagement member against the biasing force of the biasing member. Consequently, the engagement portion projected inside the insertion groove are moved to the outside, which brings the insertion groove and the through hole in a linked state. In this state, the fixture is slid along the extension direction of the insertion groove in the direction opposite to that in the attachment operation, so that the shaft portion of the attachment target section is positioned in the through hole, thereby allowing easy detachment of the fixture from the attachment target section.

Thus, the fixture of the present invention can be easily attached and detached to/from attachment objects via the attachment target section. Moreover, the attachment state where the fixture is attached to the attachment target section can be reliably retained because the small hole formed by the engagement portion and the end portion of the insertion groove is larger than the shaft portion of the attachment target section and smaller than the bulging portion of the attachment target section.

In the above-described fixture, in the state of being projected inside the insertion groove of the main body, the engagement portion of the engagement member should preferably form a large hole larger than the bulging portion of the attachment target section along with the through hole. This makes it possible to further improve the workability of the attaching operation.

Further, it is preferable that the main body is composed of a pair of plate-like members, and the engagement member and the biasing member are disposed so as to be interposed therebetween. Consequently, it becomes possible to thoroughly prevent improper cancellation of the attachment state due to interference between the engagement member and the attachment target section.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1A:
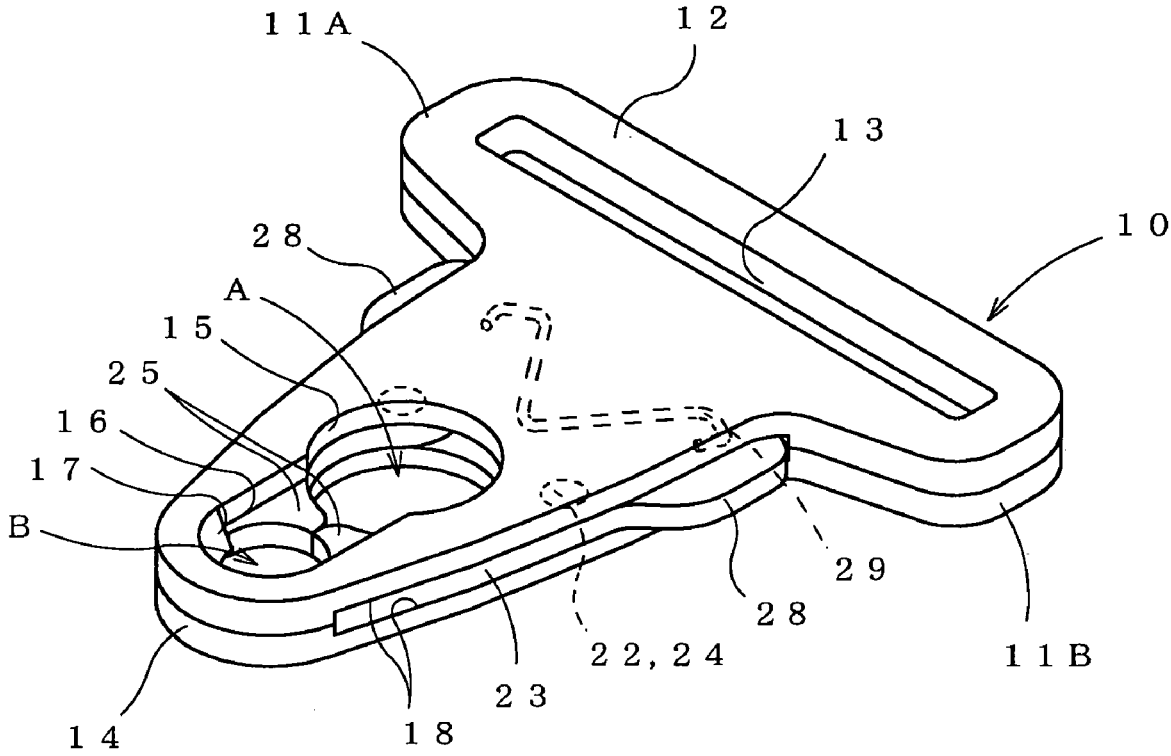
FIGS. 1A and 1B are perspective views showing a fixture in an embodiment of the present invention.
Figure 1B:
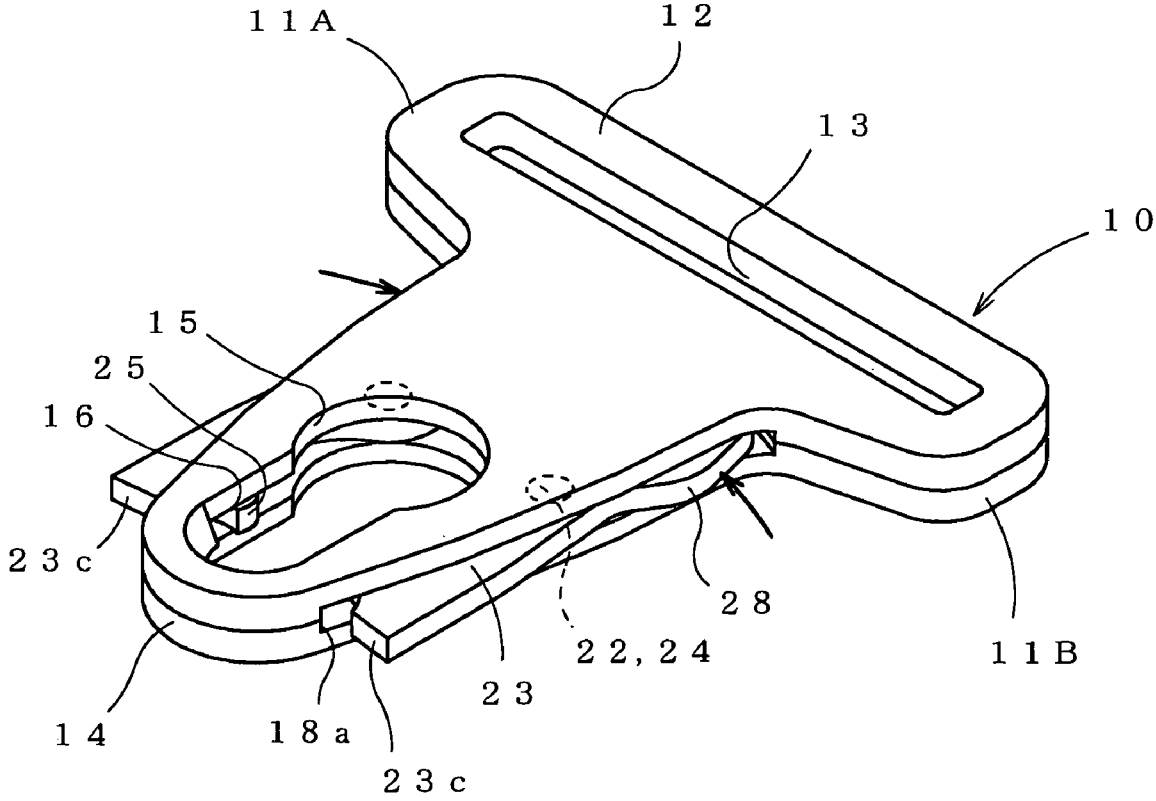
Figure 2:
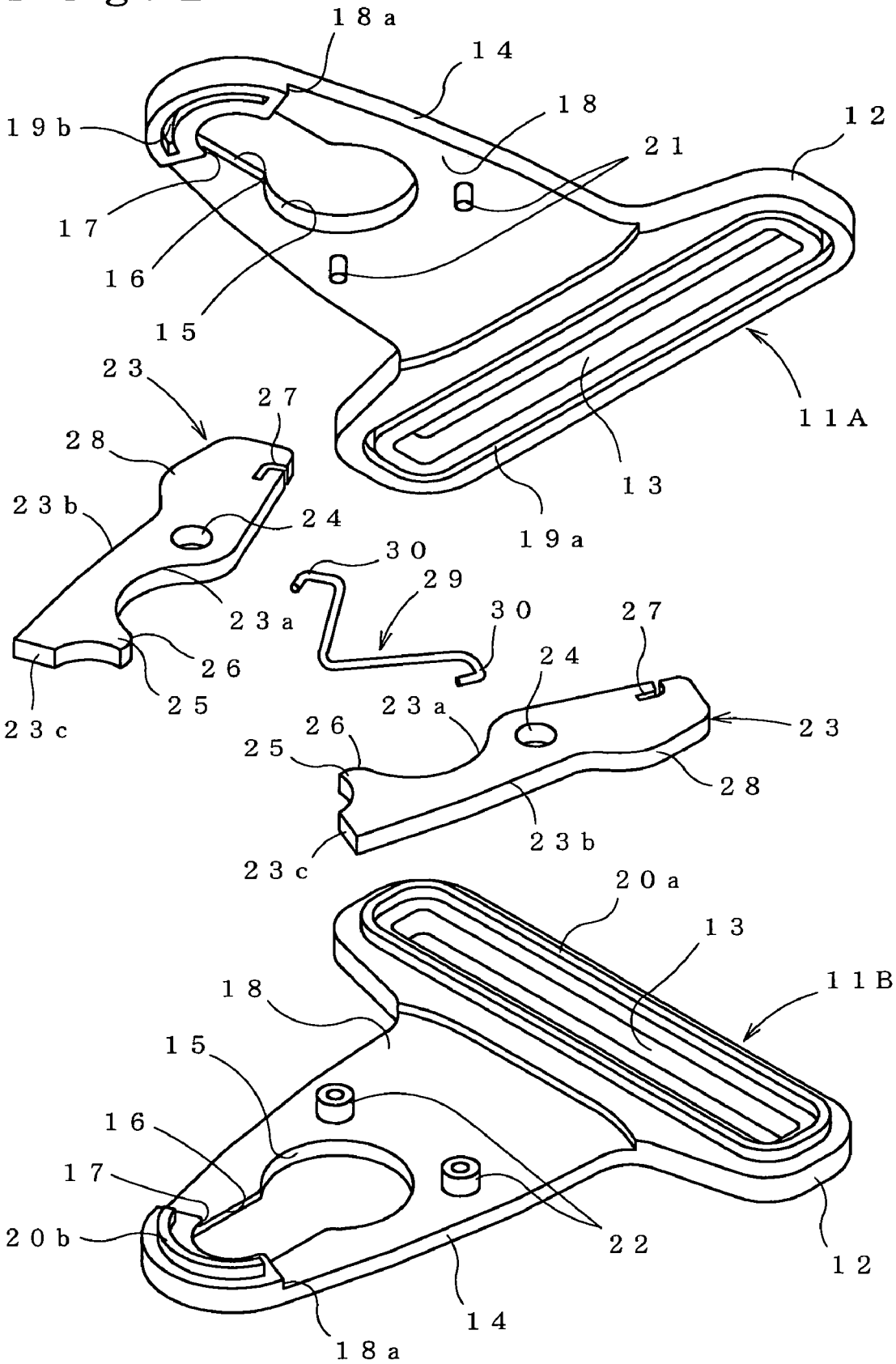
FIG. 2 is an exploded perspective view showing the fixture of FIG. 1.

FIGS. 1A, 1B and FIG. 2 show a fixture in an embodiment of the present invention. This fixture is mainly composed of a main body 10, a pair of engagement members 23 that are rotatably mounted on the main body 10, and a biasing member 29 for biasing the engagement members 23.

Figure 8A:
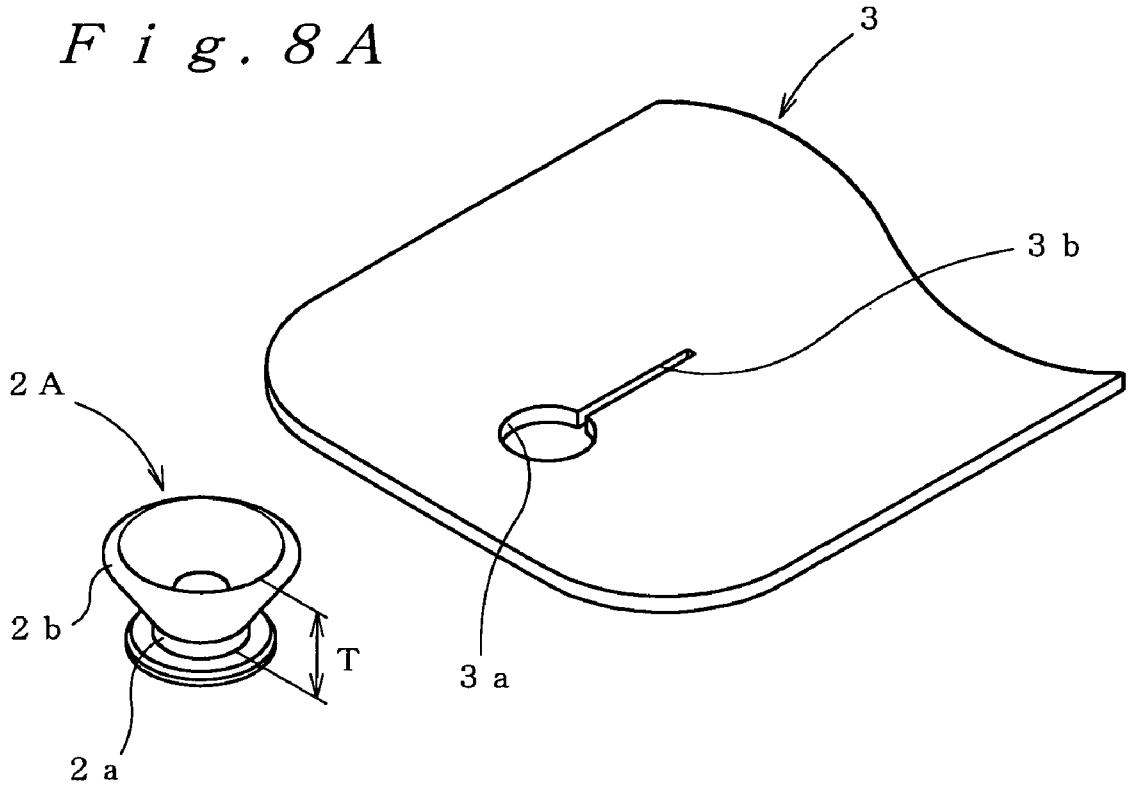
FIGS. 8A and 8B are perspective views showing a conventional structure of attaching a strip-shaped member to an attachment target section.

The main body 10 is composed of a pair of plate-like members 11A and 11B, and the engagement members 23 and the biasing member 29 are disposed so as to be interposed therebetween. More specifically, the plate-like members 11A, 11B are almost T shaped members, each of which is composed of a wide-width placement portion 12 in which a strap 3 or a strip-shaped member is placed, and a narrow-width attachment portion 14 projected from the placement portion 12 so as to form an approximate triangle. These plate-like members 11A, 11B are formed such that in the state of being assembled so as to face each other, their thickness is smaller than a total height T of the attachment target section 2. The total height T of the attachment target section 2 herein refers to a measurement from the proximal end of the shaft portion 2*a* to the top end of the bulging portion 2*b* as shown in FIG. 8A.

The placement portion 12 of the respective plate-like members 11A, 11B has a placement hole 13 provided for placing the strap 3 or a strip-shaped member such that the strap 3 is inserted in the placement hole 13 and folded, and the end portion thereof and a superimposed portion of the strap 3 are sewn together.

Figure 4A:
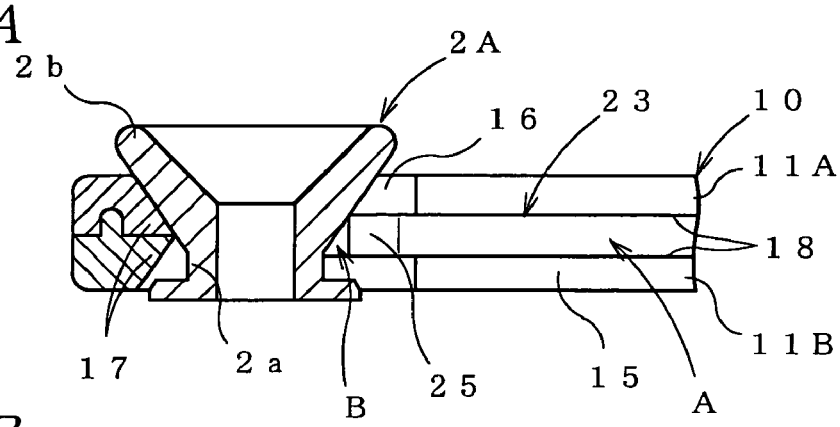
FIGS. 4A and 4B are cross sectional views showing the fixture in the state of being attached to attachment target sections different in size.
Figure 4B:
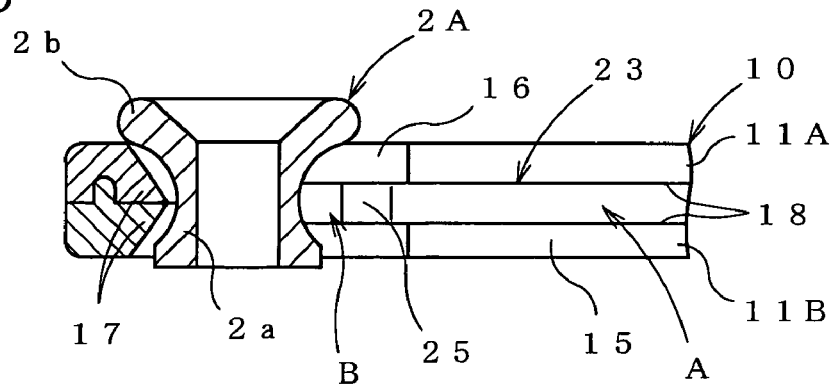

The attachment portion 14 of the respective plate-like members 11A, 11B is provided with an almost circular-shaped through hole 15 and an insertion groove 16 that is linked to the through hole 15. The diameter of the through hole 15 is slightly larger than the outside diameter of the bulging portion 2*b* of the attachment target section 2. The insertion groove 16 is in an almost oblong shape extending from the through hole 15 to the opposite side of the placement hole 13. The groove width of the insertion groove 16 is formed to be larger than the diameter of the shaft portion 2*a* of the attachment target section 2 and smaller than the diameter of the through hole 15. It is to be noted that on the inner periphery of the insertion groove 16 in the present embodiment, there is provided, as shown in FIGS. 4A and 4B, protruding portions 17 that are inclined toward the center of the thickness of the main body 10 in an assembled condition. The width of the protruding portions 17, 17 is structured to be slightly larger than the diameter of the shaft portion 2*a* of a large attachment target section 2A shown in FIG. 8A and to be smaller than the diameter of the bulging portion 2*b* of a small attachment target section 2B shown in FIG. 8B.

Further, the attachment portions 14 have recess portions 18 on which a later-described engagement member 23 and a biasing member 29 are disposed, formed on the faces that face each other. These recess portions 18 are formed such that a space formed when the plate-like members 11A and 11B are in an assembled state is slightly larger than the thickness of the engagement member 23. It is to be noted that in each of the recess portions 18, an angle of gradient of step portions 18*a*, which are positioned on the both sides of the top end of the insertion groove 16, is so set that when a top end 23*c* of the engagement member 23 that is pressed inward by the biasing member 29 comes into contact with the step portions 18*a*, the step portions 18*a* function as stoppers to stop rotation of the engagement member 23 caused by biasing force of the biasing member 29.

Further, in FIG. 2, one plate-like member 11A positioned on the upper side has a placement groove. 19*a* formed so as to surround the placement hole 13, whereas the other plate-like member 11B positioned on the lower side has a placement protruding portion 20*a*, which is press-fit in the placement groove 19*a*, formed so as to surround the placement hole 13. Moreover, the plate-like member 11A has a circular arc-shaped placement groove 19*b* formed on the top end side of the insertion groove 16 on which the recess portion 18 is not formed, whereas the plate-like member 11B has a placement protruding portion 20*b* which is press-fit in the placement groove 19*b*.

Furthermore, on the recess portion 18 of the plate-like member 11A are provided engagement protruding portions 21 formed so as to position between the through hole 15 and the placement hole 13, whereas on the recess portion 18 of the plate-like member 11B are provided bearing portions 22 on which the engagement members 23 are rotatably mounted, and in which the engagement protruding portions 21 are press-fit. These engagement protruding portions 21 and the bearing portions 22 are formed so as to form an isosceles triangle along with a top end position of the insertion groove 16.

The engagement members 23 are plate-shaped members each having an inner side 23*a* corresponding to the shape from the through hole 15 to the insertion groove. 16 of the main body 10, and an outer side 23*b* corresponding to the shape of the external periphery of the attachment portion 14 in the main body 10. The engagement members 23 have shaft holes 24 formed at the position corresponding to the bearing portions 22 for allowing the bearing portions 22 to be inserted therethrough and be rotatably placed therein. Further, the angles of top ends 23*c* of the engagement members 23 are structured to correspond to the angles of gradient of the step portions 18*a* of the main body 10, so that inward rotation of the engagement members 23 is stopped by the top ends 23*c* coming into contact with the step portions 18*a*.

On the inner side 23*a* of the respective engagement members 23, there is provided an engagement portion 25 that projects inside the insertion groove 16 and its top end comes into contact with the other engagement member 23. The engagement portion 25 is shaped so as to form, with the through hole 15, a large hole A with a diameter slightly larger than that of the bulging portion 2*b* of the attachment target section 2 and also to form, with the end portion of the insertion groove 16, a small hole B with a diameter slightly larger than the shaft portion 2*a* of the attachment target section 2 when the engagement portion 25 is in the state of being projected inside the insertion groove 16 of the main body 10. Further, at a corner portion of the engagement portion 25 positioned on the side of the through hole 15, there is provided a circular arc-shaped chamfered portion 26 for improving openness of the engagement portions 25 during the attaching operation. Moreover, on an end portion opposite to the engagement portion 25 on the inner side 23*a* of the engagement member 23, there is provided an almost L-shaped positioning groove 27 for positioning the later-described biasing member 29.

On the outer side 23*b* of the respective engagement members 23, there is provided an operation portion 28 projected outward from the main body 10 so as to be positioned at an end portion opposite to the engagement portion 25. The outer edge of the operation portion 28 is positioned more outside than the outer edge of the placement portion 12 of the main body 10, and also the size thereof is so set that when the end portion of the operation portion 28 is in the state of being pressed inside the main body 10, the engagement portion 25 is retracted from the insertion groove 16, and the top end of the engagement portion 25 is fully housed in the recess portion 18.

The biasing member 29 is made from a linear element curved to be in an almost V shape for biasing the engagement portion 25 of the respective engagement members 23 inward, and on the both ends of the biasing member. 29, there are provided almost L-shaped positioning portions 30 which are inserted in each of the positioning groove 27 and positioned and held therein. The biasing member 29 presses the end portion opposed to the engagement portion 25 in the engagement members 23 outward so as to retain the state that each of the engagement portion 25 is projected inside the insertion groove 16.

The above-structured fixture is assembled such that, for example, a pair of the engagement members 23 are disposed on the recess portion 18 of the lower-side plate-like member 11B, and then after the biasing member 29 is disposed so that the positioning portions 30 are positioned in the positioning grooves 27 of the respective engagement members 23, the plate-like member 11A is put thereon from the upper side. Then, the placement protruding portions 20*a*, 20*b* of the plate-like member 11B are press-fit into the placement grooves 19*a*, 19*b* of the plate-like member 11A, and at the same time, the engagement protruding portions 21 are press-fit into the bearing portions 22 to complete the assembling. It is to be noted that the faces facing each other may be bonded with use of an adhesive.

Then, the strap 3 or a strip-shaped member is placed in this fixture such that the strap 3 is inserted in the placement hole 13 to be folded in an almost U shape, and the end portion thereof and a superimposed portion of the strap 3 are sewn together. Therefore, if the fixture of the present invention is applied, it is not necessary to provide the through holes 3*a* and the slits 3*b* shown in the conventional example on the strap 3 or a strip-shaped member.

Figure 3A:
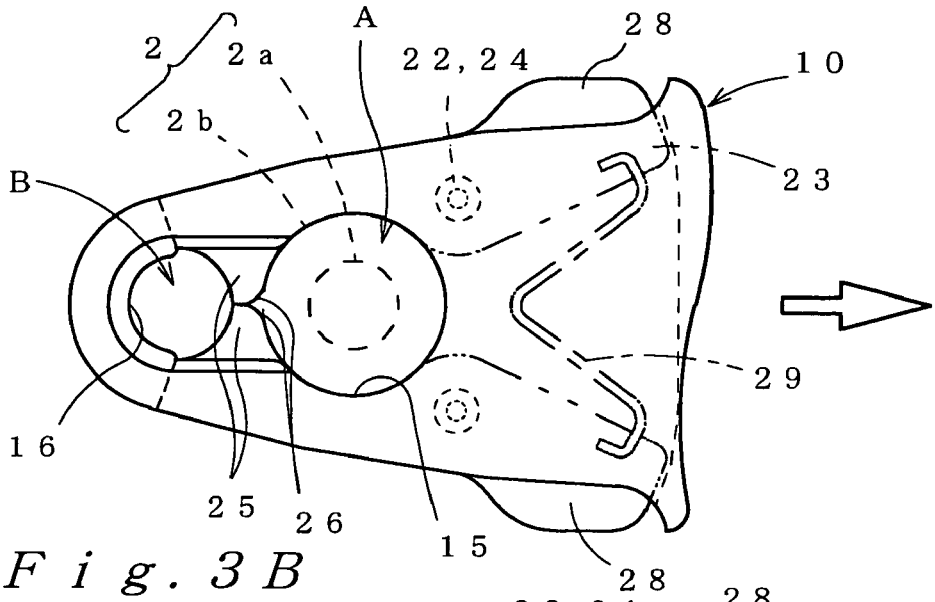
FIGS. 3A, 3B and 3C are plane views showing the operation of attaching the fixture to an attachment target section of an attachment object.

In the case of attaching the above-structured fixture to the attachment target section 2, first, a user holds the side on which the placement hole 13 is provided, and inserts the attachment target section 2 through the through hole 15 that constitutes the large hole A as shown in FIG. 3A. As a result, the bulging portion 2*b* of the attachment target section 2 is projected from the upper surface of the main body 10 through the through hole 15.

Figure 3B:
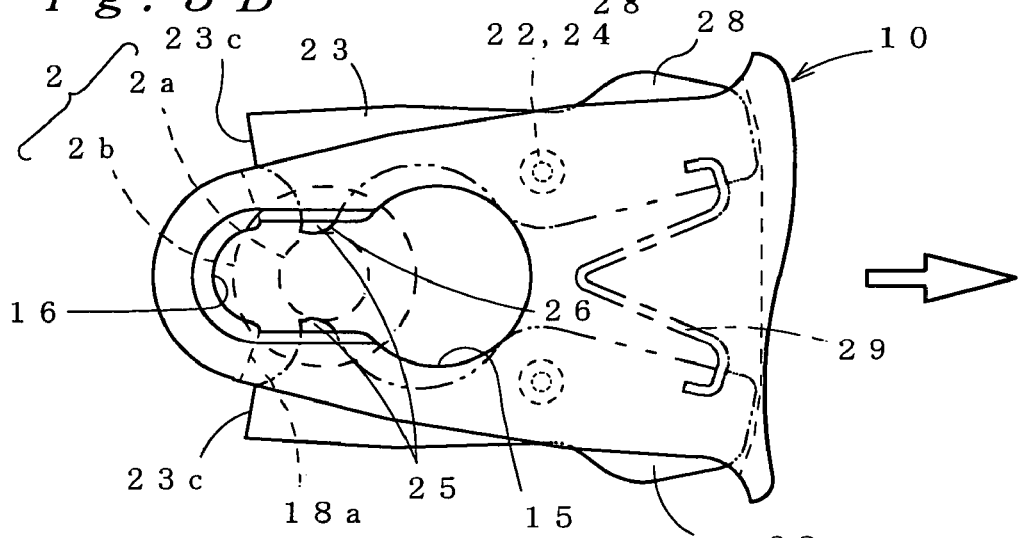

Next, as shown with an arrow in the drawing, the user pulls the fixture along the extension direction of the insertion groove 16 in the direction opposite to the extension direction. Consequently, first, the shaft portion 2*a* of the attachment target section 2 comes into contact with the engagement portions 25 of the engagement members 23. Then, due to the relation between the positions of the bearing portions 22 on which the engagement members 23 are rotatably mounted, and the movement direction of the fixture, as well as the presence of the chamfered portions 26 provided on the respective engagement members 23, pressing force from the shaft portion 2*a* acts so as to expand the engagement members 23 outward as shown in FIG. 3B, and so the engagement members 23 are rotated outward against the biasing force of the biasing member 29, which causes the engagement portions 25 to be retracted into the main body 10. Consequently, the through hole 15 of the main body 10 is linked to the insertion groove 16, and the shaft portion 2*a* of the attachment target section 2 is inserted in the insertion groove 16.

Figure 3C:
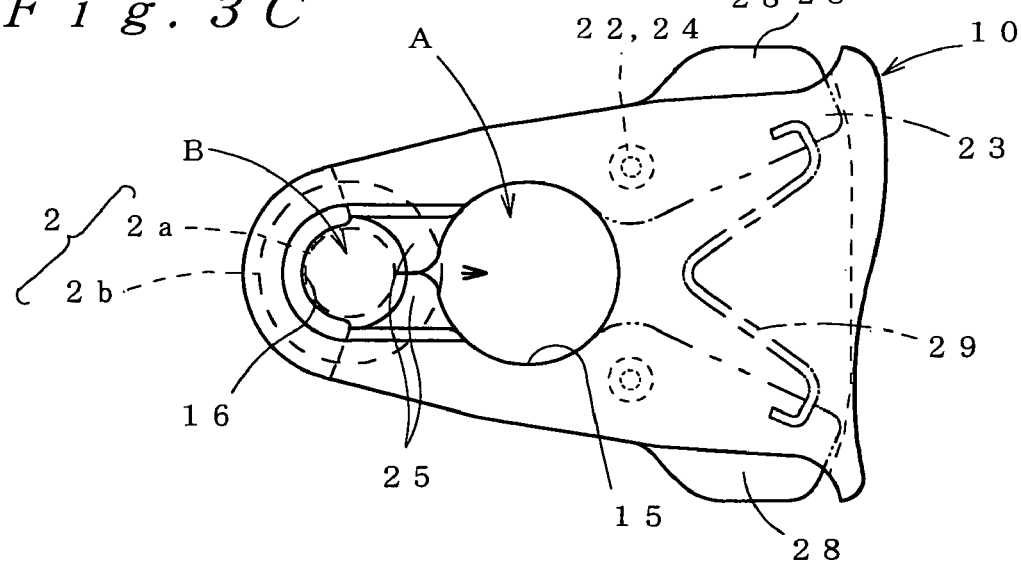

Next, once the shaft portion 2*a* of the attachment target section 2 goes over the top end position of the engagement portions 25 of the engagement members 23, the engagement members 23 are rotated by biasing force of the biasing member 29, by which the engagement portions 25 return to the state of being projected inside the insertion groove 16 as shown in FIG. 3C. It is to be noted that inward rotations of the engagement members 23 are stopped when their top ends 23*c* come into contact with the step portions 18*a* and also the top ends of the engagement portions 25 come into contact with each other. Herein, by their contact, a clicking sound is generated. This makes it possible to perform an attaching operation in a dark place with fumbling and enables amblyopic users to verify the completion of the attaching operation by ear.

In this attachment state, the shaft portion 2*a* of the attachment target section 2 is positioned in the small hole B constituted of the insertion groove 16 and the engagement portions 25 in the fixture, and the bulging portion 2*b* that is larger than the small hole B is positioned on the upper surface of the main body 10. Also, the groove width of the insertion groove 16 that is substantially equal to a diameter of the small hole B is formed to be slightly larger than the diameter of the shaft portion 2*a* of the large attachment target section 2A shown in FIG. 8A, and to be smaller than the diameter of the bulging portion 2*b* of the small attachment target section 2B shown in FIG. 8B, which prevents both the attachment target sections 2A and 2B from being disengaged from the small hole B as shown in FIGS. 4A and 4B.

Further, if force to move to the direction toward the through hole 15 is applied, in this attachment state, to the attachment target section 2 as shown with a dashed arrow in FIG. 3C, then the shaft portion 2*a* of the attachment target section 2 comes into contact with the engagement portions 25 of the engagement members 23. Herein, in this embodiment, it is so structured that the bearing portions 22 and the top end position of the insertion groove 16 is positioned to form an isosceles triangle, so that pressing force from the shaft portion 2*a* acts so as to enhance the contact force between the engagement portions 25 of the respective engagement members 23. This prevents the engagement portions 25 of the respective engagement members 23 from being opened, and prevents the shaft portion 2*a* from being positioned in the through hole 15 through this opened space to obtain an detachable state.

In the case of detaching the fixture from the attachment target section 2, a player or a user presses the operation portions 28 of the engagement members 23 inward so as to rotate the engagement members 23 against the biasing force of the biasing member 29 as shown in FIG. 1B. Consequently, the engagement portions 25 projected inside the insertion groove 16 are moved to the outside, which brings the engagement portions 25 in the state of being fully housed in the recess portions 18 of the main body 10. As a result, the insertion groove 16 and the through hole 15 become in a linked state.

In this state, the fixture is slid along the extension direction of the insertion groove 16 in the direction opposite to the arrow shown in FIGS. 3A, 3B. As a consequence, the shaft portion 2*a* of the attachment target section 2 is moved into the through hole 15. Then, by moving the fixture along the projection direction of the attachment target section 2, the user can easily detach the fixture from the attachment target section 2.

It is to be noted that the pressing operation of the operation portions 28 of the fixture performed by the user may be continued until the fixture is detached from the attachment target section 2, or may be stopped when the shaft portion 2*a* of the attachment target section 2 has been positioned in the through hole 15.

Thus, in attaching the fixture according to the present invention to the guitar 1, that is an attachment object, through the attachment target section 2, easy attachment can be achieved by simply inserting the attachment target section 2 in the through hole 15 and pulling the fixture. In detaching the fixture from the attachment target section 2, easy detachment is achieved by pressing the operation portions 28. Therefore, the fixture has good workability with respect to the attaching and detaching operations, making it possible to perform the detaching and detaching operations with one hand while holding the guitar with the other hand. As a result, if replacement of the strap 3 on stage becomes necessary for some reasons, immediate replacement can be implemented.

Further, the attachment state is reliably maintained by the engagement portions 25 of the engagement members 23 pressed inward. Moreover, if the shaft portion 2*a* of the attachment target section 2 comes into contact with the engagement portions 25, pressing force would not act in the direction to open the engagement members 23. Therefore, the fixture also has very good retentivity to retain the attachment state. As a result, if the user wildly moves on stage, there is no possibility of the strap 3 going loose from a guitar 1 and the expensive guitar 1 being dropped off.

Further in the present embodiment, the main body 10 is composed of a pair of plate-like members 11A and 11B, and the engagement members 23 and the biasing member 29 are disposed so as to be interposed therebetween. Therefore, it becomes possible to thoroughly prevent improper rotation of the engagement members 23 and resultant cancellation of the attachment state due to interference of the engagement members 23 with the guitar 1, that is an attachment object, or with the user's body.

Figure 8B:
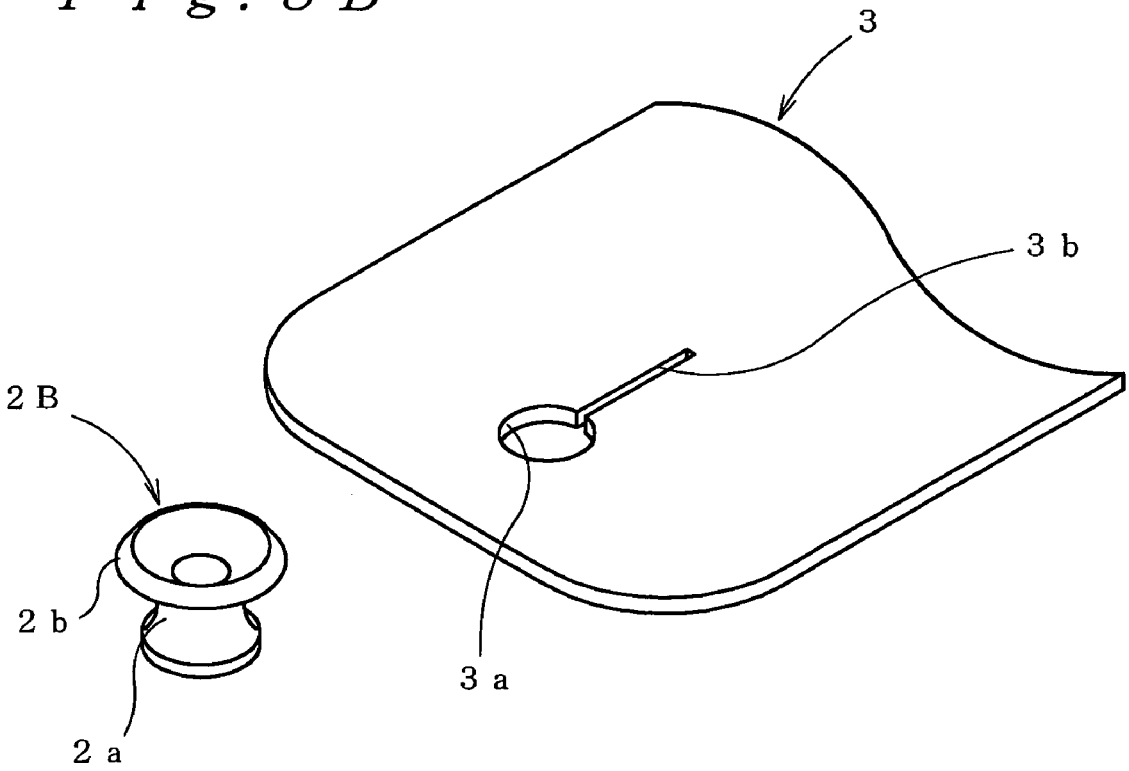

Furthermore, on the inner periphery of the insertion groove 16 in the present embodiment, there is provided protruding portions 17 that are inclined inward, so that though the shaft portion 2*a* is formed from a curved surface as shown in FIG. 8B, a stable attachment state can be retained.

It is to be understood that the fixture of the present invention is not limited to the structure of the foregoing embodiment, but is capable of numerous modifications.

Figure 5:
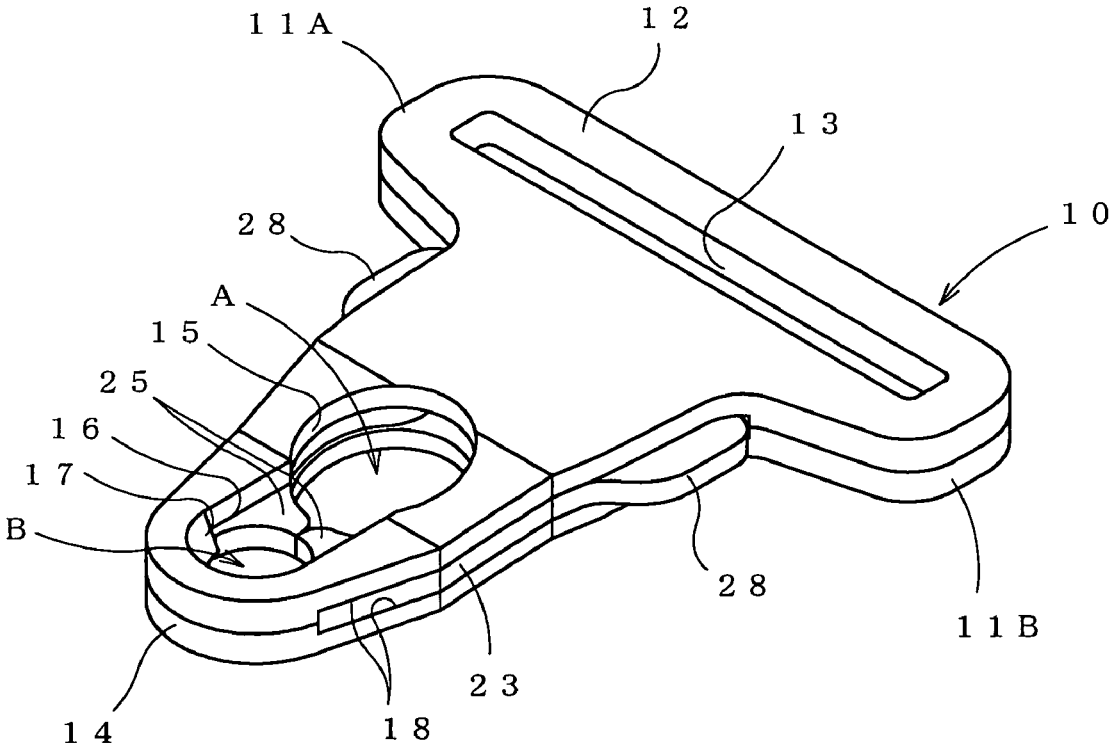
FIG. 5 is a perspective view showing a modified example of the fixture.

For example, in the aforementioned embodiment, the engagement members 23 is disposed on the main body 10 composed of a pair of the plate-like members 11A, 11B so as to form a fixture to be in a plate-like shape. However, as shown in FIG. 5, a fixture may be formed such that steps may be provided stepwise so as to position the top end portion of the insertion groove 16 at the lowermost end.

Figure 6:
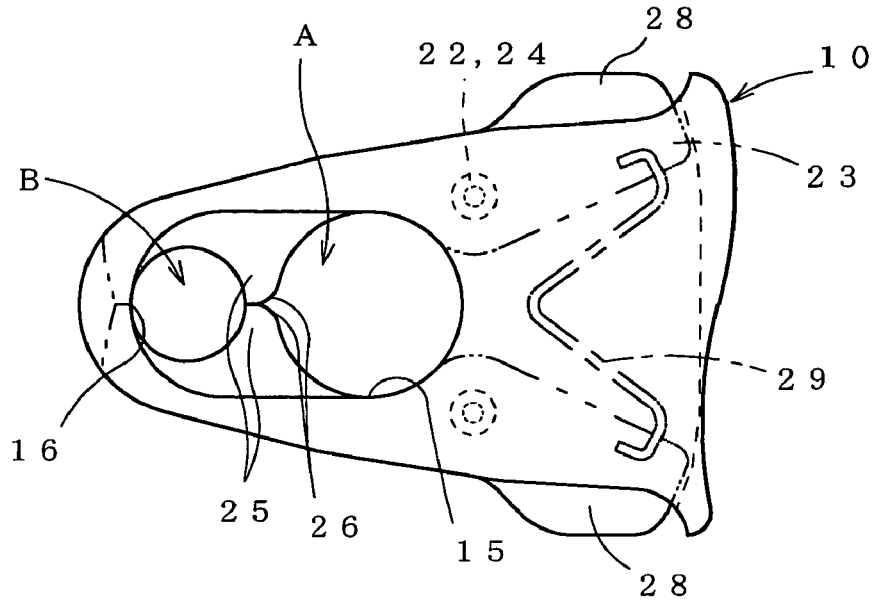
FIG. 6 is a plane view showing another modified example of the fixture.
Figure 7:
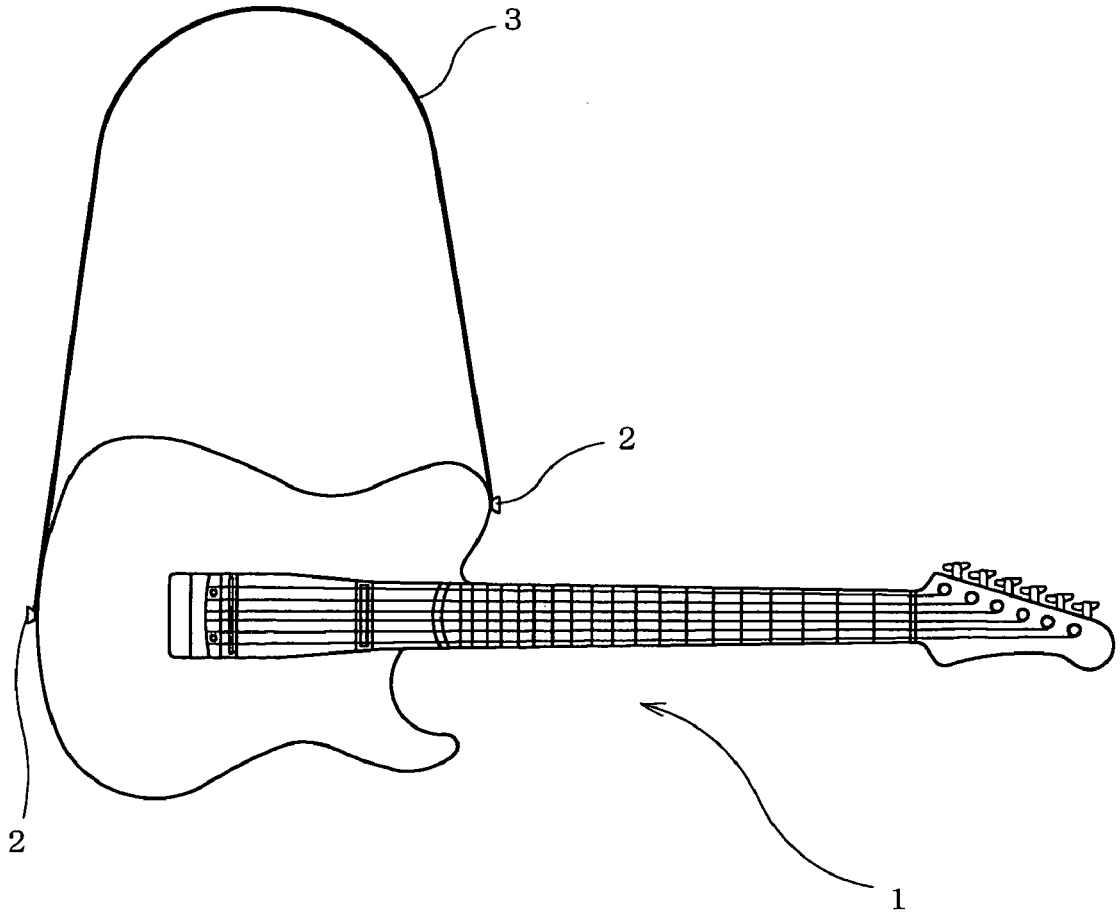
FIG. 7 is a front view showing a strap that is a strip-shaped member in the state of being attached to a guitar that is an attachment object.

Further in the aforementioned embodiment, although the insertion groove 16 is formed to have a width smaller than that of the through hole 15, the insertion groove 16 may be formed to have the same width as that of the through hole 15 as shown in FIG. 6. In other words, the through hole 15 and the insertion groove 16 may be constituted of one oblong-shaped groove. In such case, the engagement members 23 are structured such that most part of the small hole B is formed from two engagement portions 25.

Further in the aforementioned embodiment, although a stopper to stop the rotations of the engagement members 23 is constituted of the step portions 18*a* on the top end of the recess portions 18, a dedicated stopper composed of a protruding piece and the like may be provided on the edge of the insertion groove 16, or the through hole 15.

Furthermore in the present invention, although a pair of the engagement members 23 are rotatably mounted on the main body 10, only one engagement member 23 may be mounted thereon.

Further in the aforementioned embodiment, the guitar 1 is applied as an attachment object, and the fixture is detachably attached to the attachment target section 2 provided on the guitar 1. However, the present invention is also applicable as a structure to hook safety harnesses of automobiles on automotive interior panels for attachment. Moreover, a member to which the fixture is attached is not limited to strip-shaped members such as the strap 3 and safety harnesses, but line-shaped members such as ropes are also acceptable.

More specifically, as long as for detachably attaching strip-shaped members and the line-shaped members to attachment objects with an almost T-shaped attachment target section 2 provided thereon, the fixture of the present invention is applicable to any structures for many purposes, and the same operation and effect as the aforementioned embodiment are obtainable whichever the invention is applied to.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixture used in a state that an almost T-shaped attachment target section, that is composed of a shaft portion having a circular cross section and a bulging portion projected onward on a top end of the shaft portion, is disposed on an attachment object, for attaching a strip-shaped member or a line-shaped member to the attachment object via the attachment target section, comprising:

a main body composed of a placement portion in which the strip-shaped member or the line-shaped member is inserted and placed, a through hole through which the bulging portion of the attachment target section is inserted, and an insertion groove linked to the through hole and extended from the through hole to an opposite side of the placement portion in which the shaft portion of the attachment target section is inserted;

an engagement member that is rotatably mounted on the main body and that is composed of an engagement portion projected inside the insertion groove to form a small hole larger than the shaft portion and smaller than the bulging portion along with an end portion of the insertion groove, and an operation portion projected outward from the main body, wherein in the state of being projected inside the insertion groove of the main body, the engagement portion of the engagement member forms a large hole larger than the bulging portion along with the through hole; and a biasing member for biasing the engagement members so as to retain the engagement portion of the engagement member in a state of being projected inside the insertion groove of the main body.

2. The fixture as claimed in claim 1, wherein the main body is composed of a pair of plate-like members, and the engagement member and the biasing member are disposed so as to be interposed therebetween.

* * * * *